United States Patent [19]

Sepke et al.

[11] Patent Number: 4,748,713

[45] Date of Patent: Jun. 7, 1988

[54] VACUUM CLEANER ASSEMBLY

[75] Inventors: Arnold L. Sepke, Hudson; Leonard Hampton, Normal; Samuel E. Hohulin, Lexington, all of Ill.

[73] Assignee: National Union Electric, Bloomington, Ill.

[21] Appl. No.: 915,575

[22] Filed: Oct. 6, 1986

Related U.S. Application Data

[63] Continuation-in-part of Ser. No. 659,166, Oct. 9, 1984, Pat. No. 4,621,930.

[51] Int. Cl.[4] ..... A47L 9/14

[52] U.S. Cl. ..... 15/347; 15/351; 55/378; 383/11

[58] Field of Search ..... 15/347, 350, 351; 55/378, 377, 376, 374; 383/11

[56] References Cited

U.S. PATENT DOCUMENTS

| | | | |
|---|---|---|---|
| 3,150,405 | 9/1964 | Tissler | 55/374 X |
| 3,417,550 | 12/1968 | Fesco | 55/376 |
| 3,616,622 | 11/1971 | Friedman | 55/376 |
| 3,728,847 | 4/1973 | Howard et al. | 15/347 X |
| 4,139,037 | 2/1979 | McGuigan | 383/11 X |
| 4,618,420 | 10/1986 | Alanis | 15/1.7 X |

FOREIGN PATENT DOCUMENTS

| | | | |
|---|---|---|---|
| 1057187 | 2/1967 | United Kingdom | 55/376 |

*Primary Examiner*—Chris K. Moore
*Attorney, Agent, or Firm*—Alfred E. Miller

[57] ABSTRACT

An electric vacuum cleaner has a floor engaging unit, a generally vertically extending handle assembly pivotally affixed to the rear of the floor engaging unit, and a porous bag assembly mounted to the front of the handle assembly. The handle assembly is hollow to direct dust-laden air from the floor engaging unit to the bag assembly. A bottom plate, under the brush roll, has notches at its edges to enhance edge cleaning, and front wheels for the cleaner. Ridges are provided in the floor engaging unit to prevent inproper assembly of the drive belt. The handle assembly is resiliently biased upwardly, and a release is provided thereon to enable relaxation of forces on the porous bag of the porous bag assembly, to facilitate changing of the bag.

4 Claims, 16 Drawing Sheets

FIG. 12
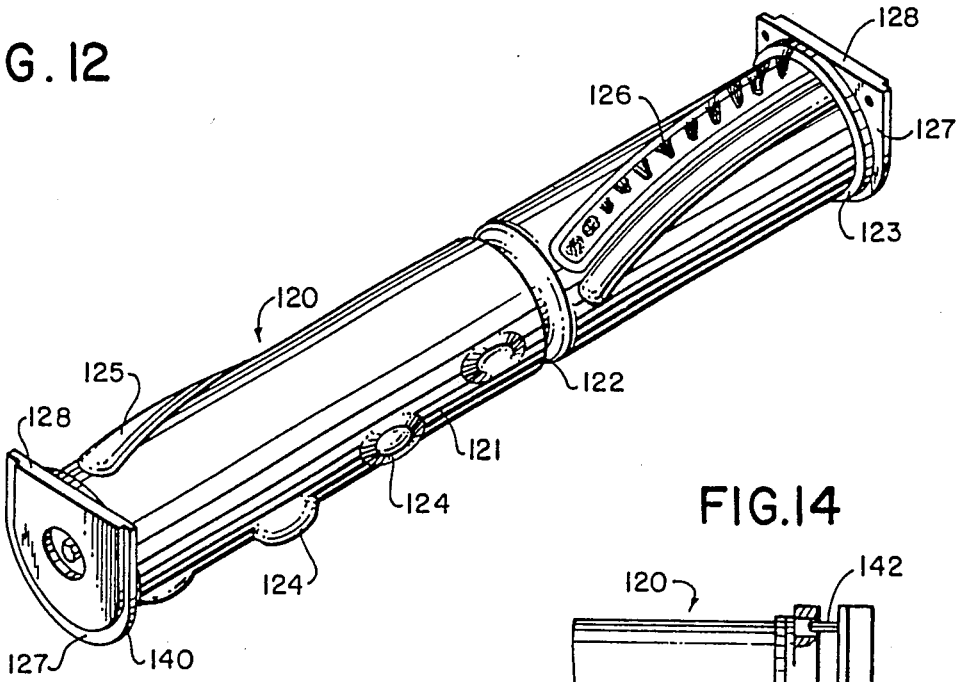
FIG. 14
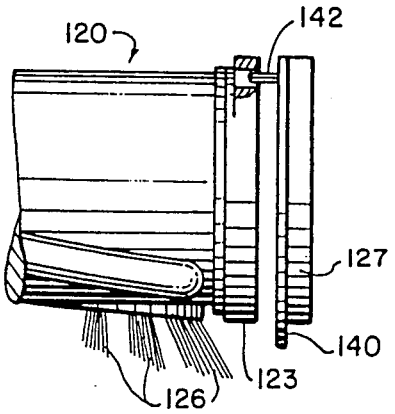
FIG. 13
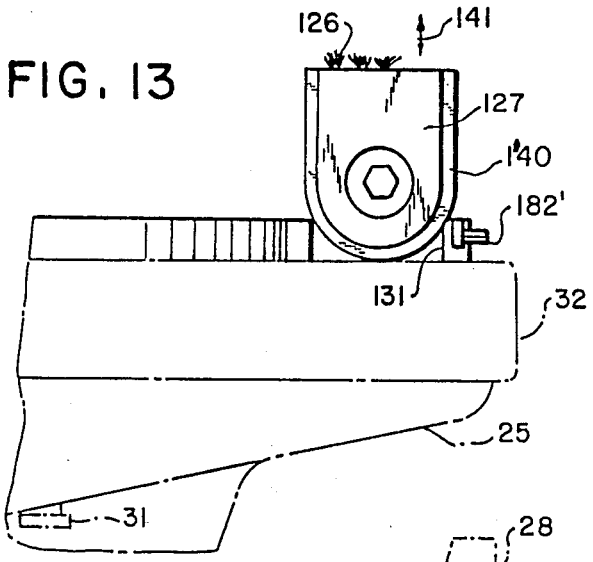
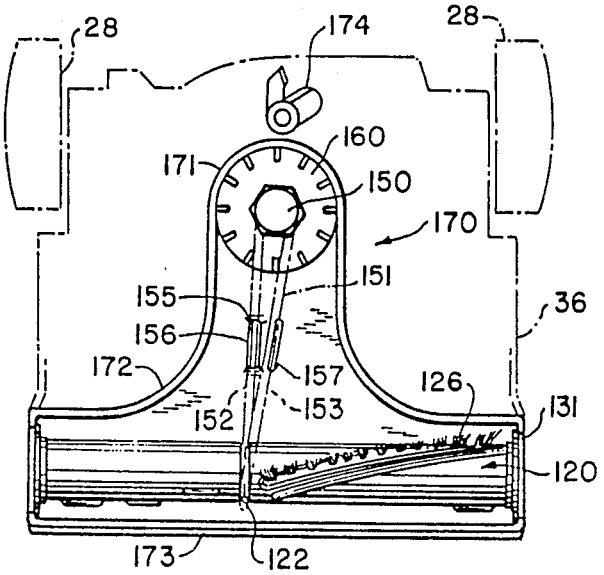
FIG. 15

FIG.21
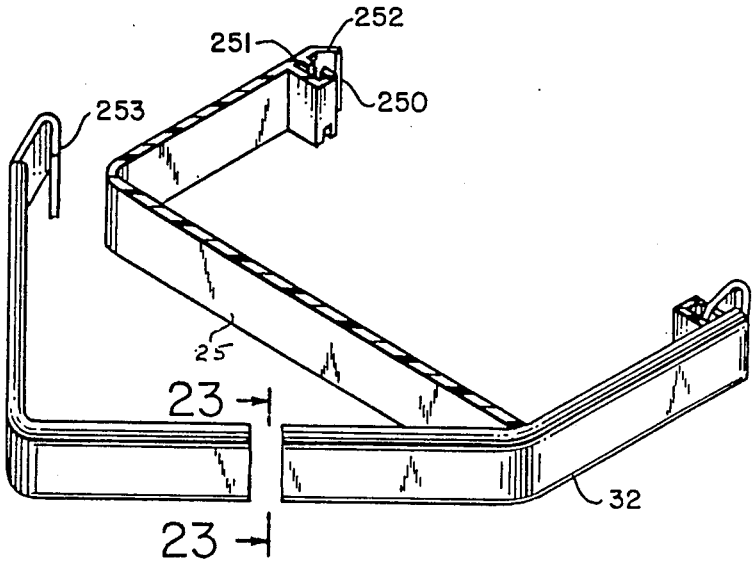
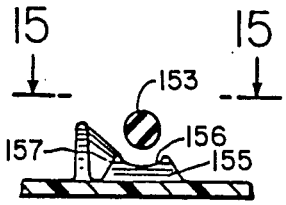
FIG.22
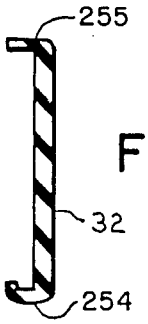
FIG.23
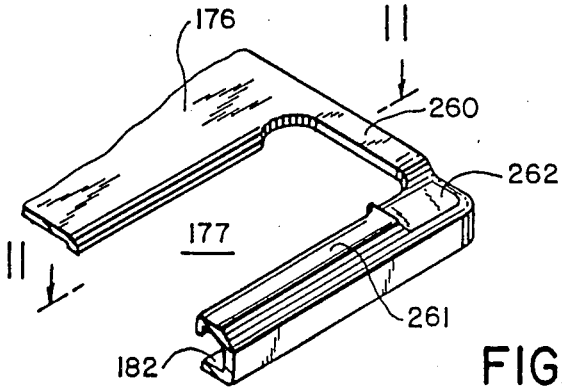
FIG.24

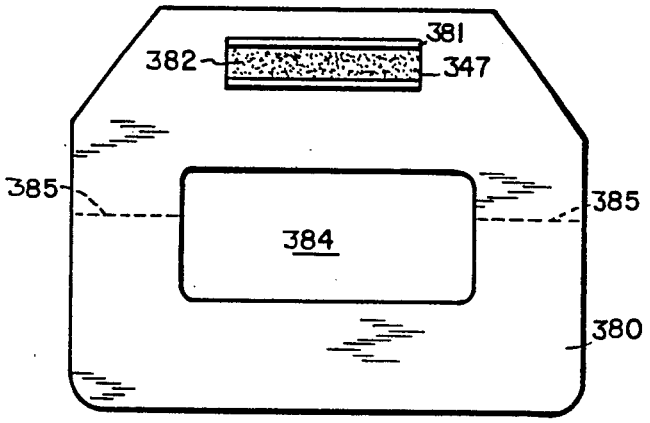
FIG. 33
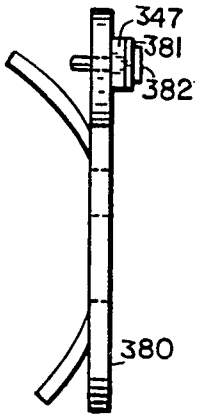
FIG. 34
FIG. 35
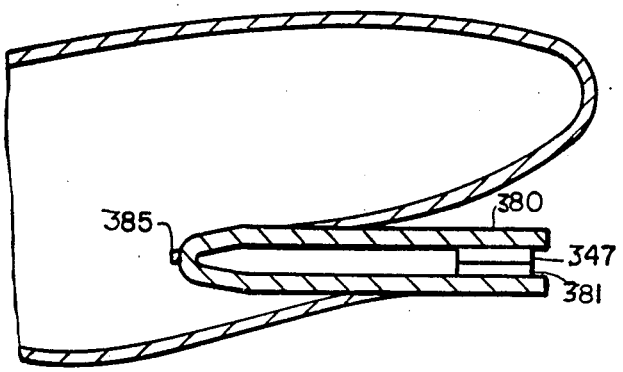

VACUUM CLEANER ASSEMBLY

This application is a continuation-in-part of application Ser. No. 659,166, filed Oct. 9, 1984, now U.S. Pat. No. 4,621,930, issued Nov. 11, 1986, and is a continuation-in-part of application Ser. No. 745,500, filed June 17, 1985, and now abandoned.

This invention relates to electric vacuum cleaners, and is more, in particular, directed to improved arrangements enabling the economical assembly of vacuum cleaners, as well as improved operation thereof. This invention is also directed to the provision of an improved arrangement for attaching a porous dirt bag within an outer bag of a vacuum cleaner of the type wherein dirt laden air is directed into the outer bag by way of a duct extending through the handle assembly and into an elbow extending into the outer dirt bag.

The present invention is specifically directed to the provision of an upright vacuum cleaner, i.e., a vacuum cleaner of the type that has a floor engaging unit with wheels, a generally vertically extending handle pivoted to the floor engaging unit, and a bag affixed to the floor engaging unit and, preferably, held by the handle, for collecting dirt.

In accordance with one feature of the invention, the dust-laden air from the floor engaging unit is directed to a bellows, and thence through a pivoted bag and handle assembly to a conduit within the handle. The conduit in the handle terminates at a forwardly extending opening adapted to be connected to a bag mounted on the front of the handle. The handle may be formed as a two-piece assembly.

In further features of the invention, front wheels for the vacuum cleaner are mounted on a bottom plate removably held to the bottom of the frame of the floor engaging unit. The bottom plate further is provided with channels at its front edges enabling more efficient cleaning at the edges of the vacuum cleaner. The floor engaging unit further is provided with a pair of projections ensuring that belt assembly in the wrong manner is difficult.

In still further features of the invention, a cover is provided to snap fit over the frame of the floor engaging unit, and a bumper is affixed to the cover in a simple and economical manner.

The present invention is also directed to the provision of a porous bag mounting arrangement having improved features, such as avoiding the necessary critical alignment between the apertures of the porous bag flange and snap connections in the outer bag flange, thereby effectively compensating for problems of correct fit resulting from part dimension variations encountered with normal manufacturing tolerances. The mounting arrangement in accordance with the invention requires minimum mounting space and can be assembled readily in dimly lit areas.

Briefly stated, in accordance with one embodiment of the invention, the snap fit projections on the outer bag flange are replaced by a permanent magnet, and a sheet of magnetic material, such as a steel plate, is affixed to the upper portion of the porous bag flange, for enabling the magnetic holding of the porous bag flange to the outer bag flange independently of manufacturing tolerances of the flanges.

In a further feature of the invention, a self-stick adhesive is applied to the steel plate on the porous bag flange, the adhesive being covered by a removable cover, such as plastic or paper. In addition, the porous bag flange is provided with a central horizontal fold line, for example by weakening of the material of the flange, so that it can be folded. In this feature of the invention, the cover may be removed from the adhesive, and the flange folded over so that the adhesive adheres to the folded over bottom portion of the flange. Other fastening media may of course be employed for this purpose. This enables closure of the aperture in the flange, to inhibit passage of dirt therethrough in the disposal of the porous bag.

In accordance with a still further feature of the invention, instead of the magnet and plate of the above embodiments of the invention, releasable locking surface fasteners, such as locking fiber surface fasteners, are provided in aligned regions of the tops of the porous bag flange and outer bag flange, for enabling the simple releasable holding of the flanges together.

These and other features of the invention will be more clearly understood by reference to the following disclosure of the invention, and the accompanying drawings, wherein:

FIG. 12 is a perspective view of the Brush Roll;

FIG. 13 is a side view illustrating the assembly of the Brush Roll;

FIG. 14 is an enlarged view of a portion of the end of the Brush Roll illustrating its mounting cap thereon;

FIG. 15 is a view of the underside of the floor engaging unit with the bottom plate removed;

FIG. 21 is a perspective view illustrating the assembly of the bumper on the cover;

FIG. 22 is a cross sectional view illustrating the projection ensuring the proper assembly of the belt;

FIG. 23 is a cross sectional view of the bumper; and

FIG. 24 is a perspective view of a portion of the bottom plate illustrating the formation of a channel at the edge thereof.

FIG. 33 is a frontal view of a modification of the porous bag flange of the embodiment of the invention of FIG. 26;

FIG. 34 is a side view of the flange of FIG. 33;

FIG. 35 is an illustration of the porous bag flange of FIG. 33, folded to prevent escape of dirt.

Figure 1:
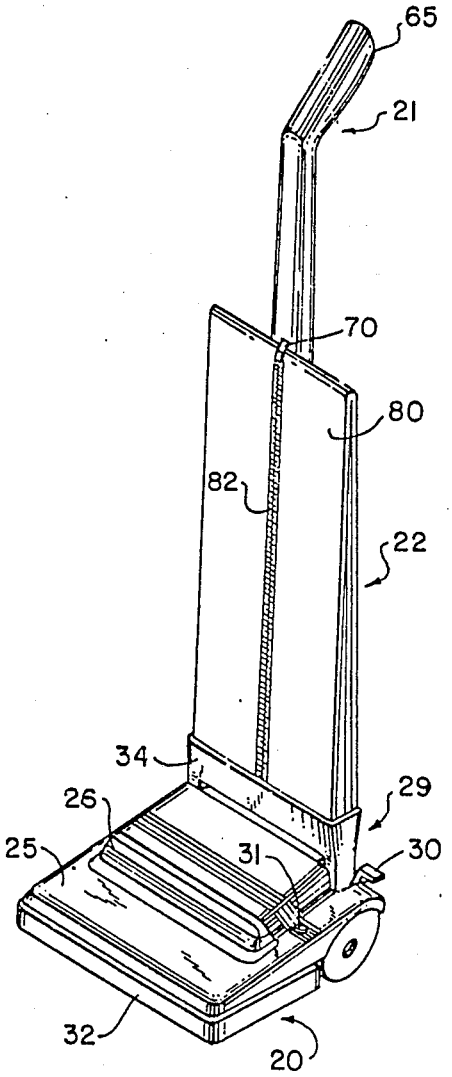
FIG. 1 is a perspective view of a vacuum cleaner in accordance with the invention.
Figure 2:
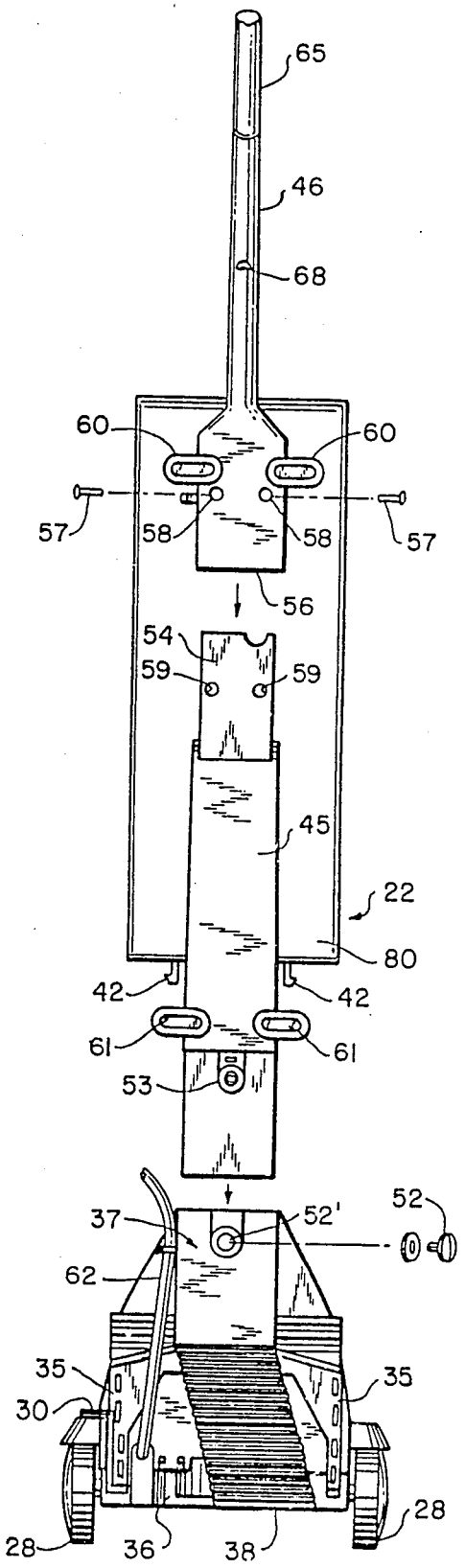
FIG. 2 is a partially exploded rear view of the vacuum cleaner.
Figure 3:
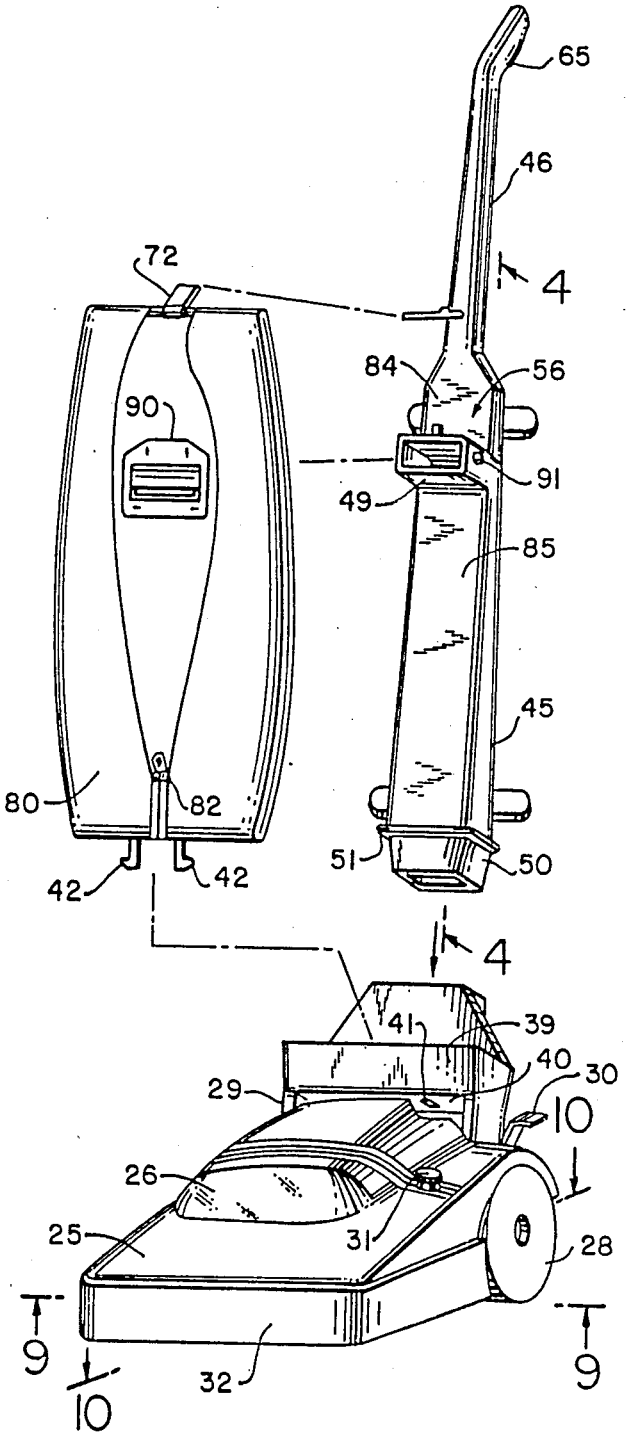
FIG. 3 is an exploded perspective view of the vacuum cleaner.

Referring now to the drawings, and more in particular to FIGS. 1–3, the vacuum cleaner in accordance with the invention is comprised generally of a floor engagement unit 20, a handle assembly 21 and a bag assembly 22.

Figure 16:
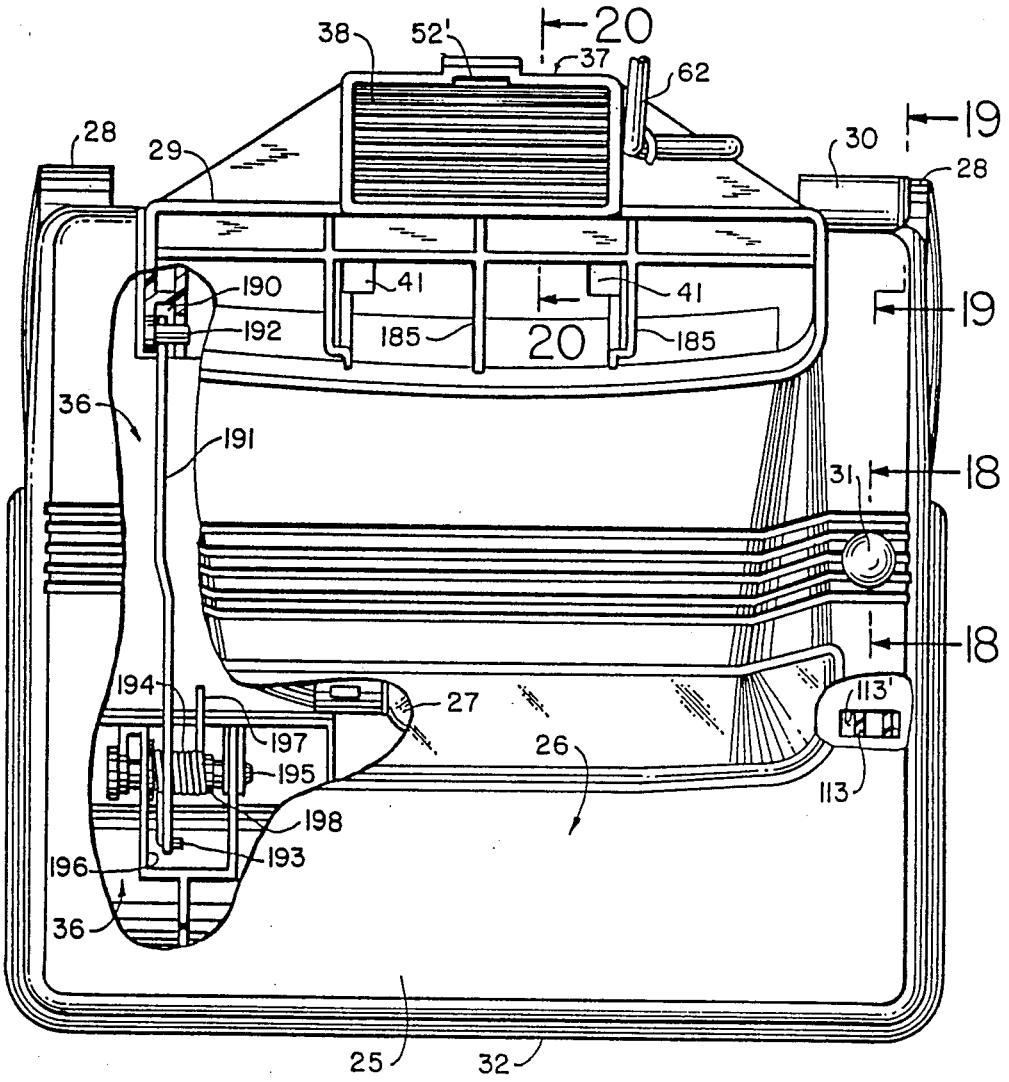
FIG. 16 is a top view of the floor engaging unit with a portion thereof broken away to show a resilient biasing arrangement of the handle.

The floor engagement unit 20 is comprised of a cover for example of molded plastic. The cover may be provided with a transparent window 26, so that a lamp 27 (as shown in FIG. 16) may be mounted therebehind to enable illumination of the area in front of the vacuum cleaner.

As further shown in FIGS. 1–3, the floor engagement unit includes a pair of rear wheels 28, and a handle and bag support 29 hinged to the rear of the floor engaging unit. A lever 30 is provided to release the handle and the bag support 29 to be pivotally moved between a substantially vertical position as illustrated in FIG. 1, and a further extreme position substantially parallel to the floor. In addition, a switch button 31 may be mounted at a top position on the cover 25, and a resilient bumper 32, for example of elastomeric plastic or rubber, may extend from the front of the cover and the adjacent portions of the side of the cover.

Figure 19:
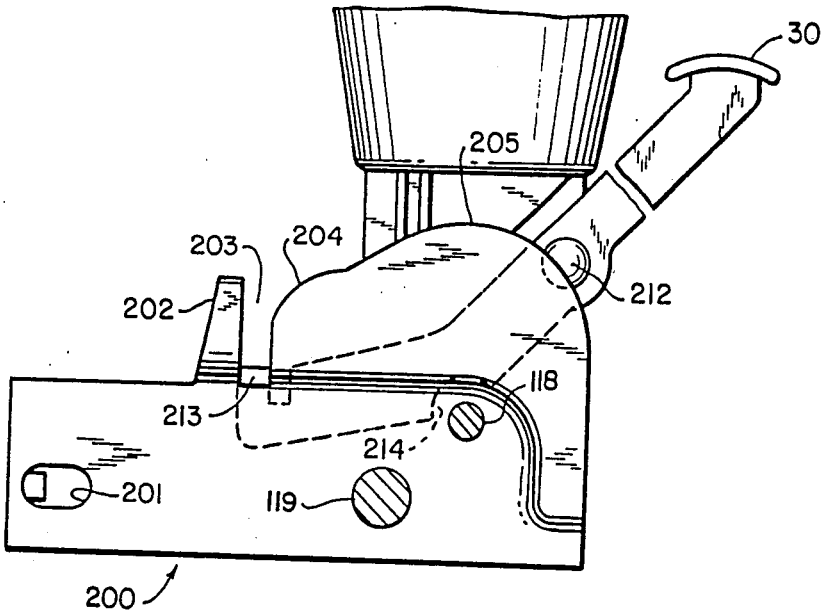
FIG. 19 is a side view of the notch plate assembly for controlling the position of the handle.

The handle and bag support 29 is comprised of a pair of arms 35 having one end pivotally mounted to a base 36 of the floor engaging unit 20, for example as seen in FIG. 1. The pivotal axis 118 of the handle and bag support 29 is seen in FIG. 19. The configuration of the frame will be discussed in greater detail in the following paragraphs. The handle and bag support, which may also comprise a molded plastic element, also has a substantially rectangular cross section receptacle 37 at its rear, the receptacle 37 being open at its upper and lower ends to define a vertical conduit. A flexible bellows 38, for example of rubber or elastomeric plastic, is sealingly connected to the lower open end of the receptacle 37, and extends to a connection on the frame 36 as will be discussed in greater detail in the following paragraphs.

The handle and bag support 29 further comprises a substantially rectangular receptacle 39 in the front portion thereof, the receptacle 39 also preferably having a substantially rectangular cross section. The receptacle 39 is open at its upper end, for receiving the bag assembly, and is provided with means at its lower end for holding the lower ends of the bag assembly. For this purpose, the receptacle 39 may have a lower wall 40 with apertures 41 for receiving resilient mounting prongs 42 in the lower portion of the bag assembly, as more clearly shown in FIGS. 2 and 3. Since the enlarged lower ends of the mounting prongs 42 extend through the apertures 41, to engage the lower sides of the bottom wall 40 of the receptacle 39, it is apparent that the bag assembly may be released at its bottom end, for example by manually engaging the lower ends of the prongs 42, below the wall 40, to force them in a direction to release them from engagement with the bottom wall 40

The handle assembly 21, as illustrated in FIGS. 1–4, is comprised of a lower tubular portion 45 defining a duct 47, which may be of substantially rectangular cross section, the duct being axially open at its lower end and provided with a bend 48 at its upper end to define a port 49 extending substantially normally to the axis of the tubular portion 45, and facing forwardly of the vacuum cleaner. The lower end 50 of the portion 45 is shaped to fit in the receptacle 37 of the handle and bag support 39. For this purpose, for example, the lower portion 50 may be slightly tapered on its outside surface while maintaining a smooth inner wall. A rib 51 protrudes at the top of the tapered end. In order to removably hold the handle assembly to the floor engagement unit 20, a suitable screw 52 (with a washer), as illustrated in FIG. 2, may extend through the rear of the receptacle 37, for example to be threaded in a hole 53 aligned therewith in the lower end 50 of the handle assembly.

The lower portion 45 of the handle assembly is further provided with a projection 54 extending longitudinally thereof at its upper end, i.e., the end through which the port 49 projects. While the projection 54 may be hollow, to reduce weight and simplify manufacture, it is not interconnected to the duct 47.

The handle 46 is comprised of a preferably hollow member formed with a receptacle portion 56 at one end for sealingly receiving the projection 54, to enable assembling of the handle on the lower portion 45. The handle 46 may be held to the lower portion 45 by any convenient means, for example by plastic snap pins 57 extending through holes 58 and the handle 46 and holes 59 aligned therewith in the projection 54. The handle 46 and lower portion 45 may be further provided with pairs of laterally extending projections 60 and 61 respectively to enable storage of the electric cord 62 by wrapping therearound in conventional manner (not illustrated).

The upper end of the handle 46 is preferably bent slightly to the rear of the vacuum cleaner to define a hand grip 65.

Figure 4:
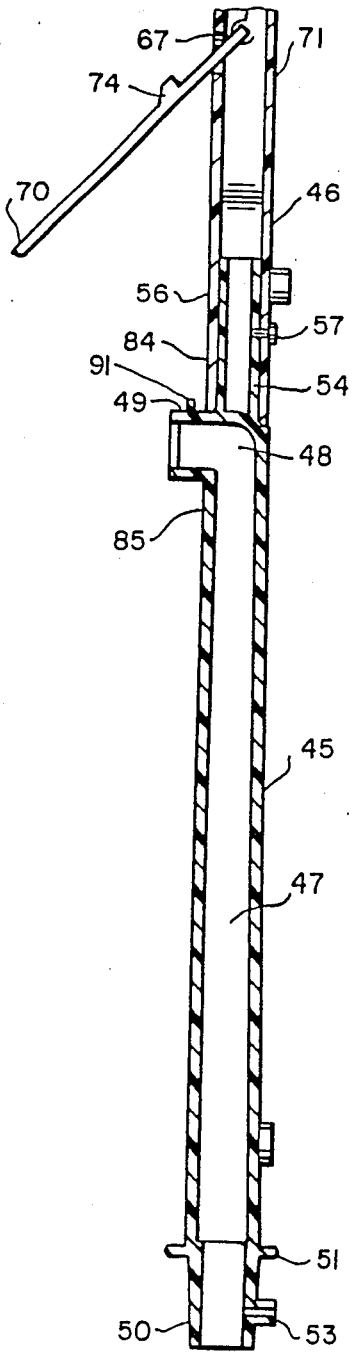
FIG. 4 is a cross sectional view of a portion of the handle assembly.
Figure 5:
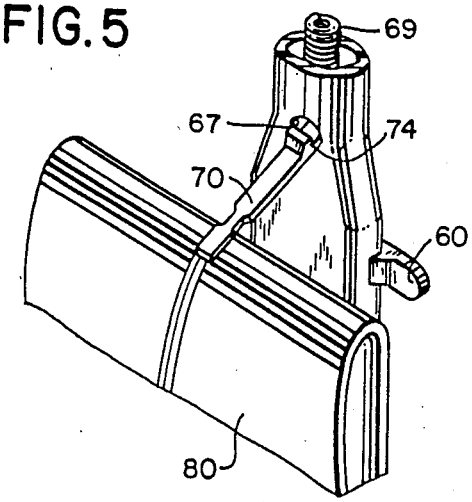
FIG. 5 is a perspective view for illustrating a portion of the assembly for holding the bag.

In order to enable holding of the bag assembly to the handle, a hole 67 is provided at the front of the handle slightly above the receptacle portion 56, as illustrated in FIGS. 4 and 5. A further hole 68 is provided in the rear of the handle 46, as illustrated in FIG. 2, the hole 68 being upwardly spaced from the hole 67 toward the hand grip 65 thereof. The hole 68 is adapted to serve as a retainer for one end of a helical spring 69 (the spring 69 being more clearly seen in FIG. 5). For example, the upper end of the spring 69 may have a loop (not illustrated), the hole 68 having an inverted U-shape, or provided with another form of central projection, for receiving one end loop of the spring 69. It is of course apparent that any other conventional means may be employed for holding the upper end of the spring 69, such as for example a suitable pin extending through the handle 46.

The lower end of the spring 69 is affixed by any conventional means to a bag retainer 70, for example by means of a lower loop 71 extending through a hole (not illustrated) in one end of the retainer 70. The retainer 70 is preferably comprised of a molded strip of flexible plastic material, the other end 72 thereof being suitably formed to enable holding of the bag assembly. For example, referring to FIG. 6, when the upper end of the bag assembly 22 includes a transverse rod 73, the retainer 70 may be formed with a loop-shaped end 72 surrounding the rod. The retainer 70 is further provided with an upwardly extending detent 74 as more clearly seen in FIGS. 4 and 5. The detent 74, in the form of a projection, is positioned generally adjacent the end of the retainer to which the spring 69 is affixed. The detent 74 and hole 67 are shaped and proportioned to enable the detent 74 to pass through the hole if the retainer is held downwardly against the bottom of the hole, i.e., the side of the hole 67 toward the floor engaging unit 20. If the retainer 70 is not so held downwardly, the detent 74 engages the side of the hole 67 to inhibit further movement of the retainer 70 through the hole 67.

Figure 6:
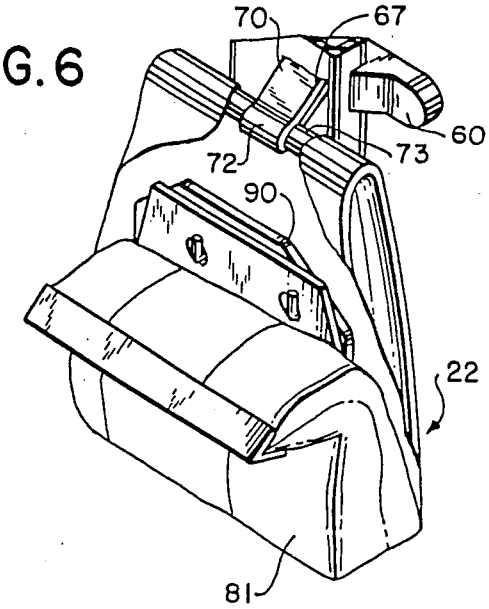
FIG. 6 is a perspective view further illustrating the arrangement for holding the inner and outer bags.

In use of the vacuum cleaner, the retainer 70 is positioned with the detent 74 within the interior of the handle 46, whereby the spring 69 resiliently urges the bag assembly 22 upwardly, i.e., toward the hole 67 in the handle. The hole 67 is hence positioned such that when the bag assembly is fully extended by the force of the spring 69, the top of the bag assembly is adjacent the hole 67 as illustrated in FIG. 6. When the bag assembly 22 is thus stretched, it is difficult to open the outer bag 80 thereof to replace the disposable inner filter bag 81. Accordingly, the user may relieve the resililent force on the bag by pulling the top of the bag, and hence the retainer 70, against the force of spring 69, until the detent 74 passes through the hole 67 to latch against the outside of the handle. In this position of the retainer, sufficient slack is provided in the mounting of the bag assembly so that the outer bag 80 may be opened to enable replacement of the inner bag.

After the replacement of the inner bag, downward pressure on the retainer 70, adjacent the detent 74, enables the detent to again pass through the hole 67, to enable the spring 69 to resiliently move the top of the bag assembly again to the vicinity of the hole 67.

As illustrated in FIG. 1, the bag assembly 22 is positioned forwardly of the handle assembly, with its upper end held by the retainer 70 and its lower end extending into the receptacle 39. The outer bag 80 of the bag assembly, for example of cloth or perforated plastic, is provided with a zipper 82 extending longitudinally of the bag and centrally between the sides thereof, from the region of or below the top of the receptacle 39 to the top of the bag 80. The rear of the outer bag 80 is provided with an aperture (not illustrated) to closely fit over the port 49 of the handle assembly. The frontal portions 84 and 85 of the handle 46 and handle assembly lower portion 45 adjacent the port 49 are flat and in a plane directly forward of the handle assembly, and generally parallel to the upper transverse rod 73 of the bag, as well as the axis of the wheels 28.

Figure 7:
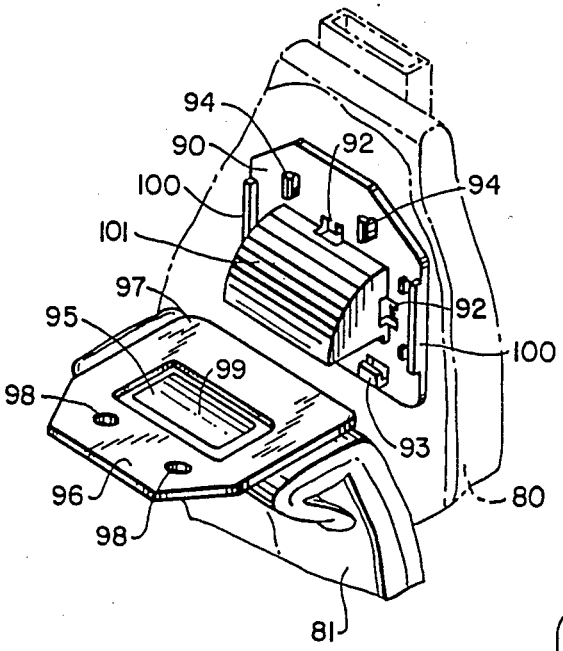
FIG. 7 is a perspective view illustrating in greater detail the arrangement in accordance with the invention for holding the bags.

A retaining plate 90 (FIGS. 3, 6 and 7) is fit over the port 49, on top of the rear of the bag 80, to hold the rear of the bag 80 against the surfaces 84 and 85 of the handle assembly. In order to hold the retaining plate, and hence the rear of the bag 80, in this position, the sides and top of the port 49 are provided with snap projections 91 (FIG. 3) positioned to enter apertures 92 of the retainer plate, to releasably hold the retainer plate and the rear of the bag 80 against the handle assembly.

The retainer plate 90 is further provided with forwardly extending lower hooks 93 and upper hooks 94 adapted to receive and hold the disposable filter bag 81. For this purpose the upper opening 95 of the disposable filter bag 81 is surrounded by a flat member 96, for example of cardboard, having a lower edge 97 adapted to be fit behind the lower hooks 93, and a pair of upper holds 98 adapted to fit over the upper hooks 94, so that, upon engagement of the hooks 93 and 94 of the retainer plate with the element 96, and generally lowering the element 96, the bag 81 is sealingly held to the plate 90, to permit passage of air from the duct 47 through the port 49, retainer plate 90 and a central hole 99 of the flat member 96, to the interior of the bag 81. The retainer plate 90 may further be provided with forwardly extending ridges 100 on its lateral edges, to insure the proper centering of the flat member 96. In addition, the retainer plate may be formed, on its forward side, with a flow director 101, for example a hood-shaped extension, for directing the flow of air downwardly into the bag 81.

The retaining plate 90, as well as the rear of the handle assembly may be of a molded plastic material.

Figure 17:
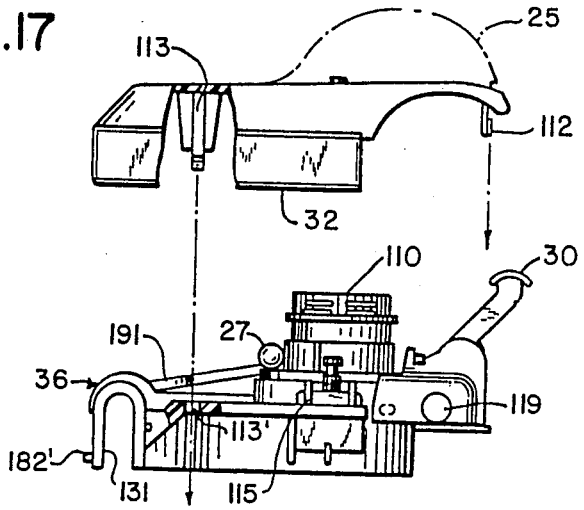
FIG. 17 is an exploded view illustrating the assembly of the frame and cover.

As illustrated in FIG. 17, a motor 110 is mounted by conventional means on top of the molded plastic frame 36. The frame 36 has at least one hook-shaped projection 111 adapted to be engaged by a hole (not shown) by a downwardly extending rear wall portion 112 of the molded plastic cover 25. The molded plastic cover 25 has several downwardly extending internal snap pins 113 adapted to engage suitable holes in the frame 36, so that the cover 25 is releasably held onto the frame 36 by the snap pins 113 and hook-shaped projection 111. FIG. 17 also illustrates the holding of a switch 114 to the top of the frame 36, by snap arms 115 molded to the frame. In addition, a transverse hole 119 is provided at the rear of the frame for receiving the axle (not shown) of the wheels. The front of the frame is provided with an inverted channel 116 for receiving the brush roll, as will be discussed in greater detail in the following paragraphs.

Figure 11:
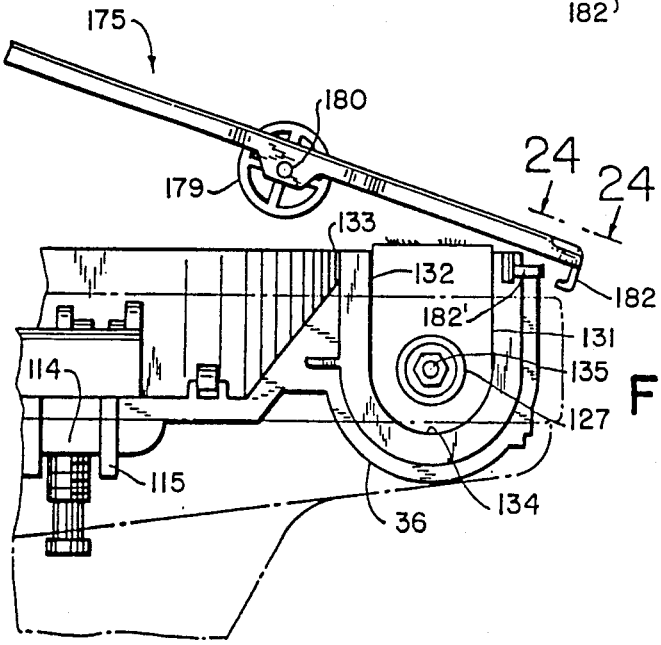
FIG. 11 is an enlarged side view of a portion of the floor engaging unit illustrating the assembly of the bottom plate thereon.

As illustrated in FIGS. 12 and 14, the brush roll 120 is comprised of a central generally cylindrical member 121 having an annular groove 122 for receiving a drive belt, the cylindrical portion 121 being mounted for rotation in end caps 123. The brush roll 120 is conventionally provided with spaced spiral projections 124, spiral projections 125 and spiral brush elements 126. The present invention is not directed to the specific arrangement of such elements on the brush roll. In order to facilitate assembly and disassembly of the brush roll in the vacuum cleaner, in accordance with the invention resilient molded mounting caps 127 are formed, for example of molding on the caps 123. The mounting caps 127 have one flat edge 128 adapted to be positioned slightly below the bottom of the frame 36. The other sides thereof being shaped to fit corresponding recesses 131 in the side walls of the frame 36. For example, the recesses 131 may have straight parallel sides 132 extending from the bottom edge 133 thereof the sides 132 being joined by a semi-circular portion 134 concentric with the axis of rotation 135 of the brush roll, as illustrated in FIG. 11. As further illustrated in FIGS. 12 and 14, the mounting caps 127 are outwardly flanged as indicated at reference numeral 140, the flange 140 engaging the inside of the side wall of the frame 36 to inhibit axial displacement of the brush roll. As illustrated in FIG. 13, the brush roll may be installed and removed from the frame 36 simply by insertion or removal thereof in the direction of the arrows 141. This mounting arrangement further enables the brushes 126 of the brush roll to approach as nearly as possible the sides of the vacuum cleaner. Relative rotation of the end cap 123 and the mounting cap 127 may be inhibited by molding a pin 142 on the mounting cap, to engage a corresponding hole in the end cap 123, as illustrated in FIG. 14.

Referring now to FIG. 15, showing the bottom of the frame 36, a pulley 150 (affixed to the motor 110 of FIG. 17 by conventional means), projects through the bottom of the frame, for receiving a belt 151, the belt 151 extending around the pulley 150 and the annular groove 122 of the brush roll for rotating the brush roll in the conventional manner. In such arrangements, since the brush roll has a horizontal axis and the pulley has a vertical axis, the course 152 of the belt extending to the top sides of the brush roll must extend to a predetermined side of the pulley, in order for the brush roll to rotate in the proper direction. In accordance with the invention, in order to ensure that the belt is always properly installed, i.e., it cannot be installed in the improper manner, as illustrated in FIGS. 15 and 22, a first ridge 155 is formed in the bottom of the frame, the ridge 155 extending along the course 152 of the belt and having a groove 156 extending in its sower surface, the groove 156 being spaced slightly from the course 152 of the belt. A further projection 157 is provided extending downwardly from the bottom of the frame 36, extending longitudinally above the other course 153 of the belt. The ridge or projection 157 is higher than the projection 155, extending to a height such that it would contact the course 152 of the belt, which is closer to the frame 36 at its front end, if the course 152 were installed incorrectly to extend to the other side of the pulley. Accordingly, incorrect installation of the belt will be immediately apparent to a user, since such incorrect installation will result in one course of the belt contacting the ridge 157. It is of course apparent that the illustrated shape of the projections 155 and 157, while preferred, is optional, and that the objects of the invention may be achieved by providing a single projection positioned to engage the course of the belt closer to the frame 36, if it is installed in the improper position.

Referring again to FIG. 15, a fan or impeller 160 is mounted on the motor shaft above the pulley 150. The impeller 160 is positioned above the bottom wall of the frame 36, so that only a coaxial portion of the impeller 160 is visible through a hole in the bottom of the frame 36, as illustrated in FIG. 15. An open bottom housing 170 depends from the bottom of the housing 36, the housing being defined by vertical (when the vacuum cleaner is in operation) walls 171–173. The wall portion 171 surrounds the rear and sides of the hole through which the impeller 160 is visible in FIG. 15, this wall portion extending into curved wall portions 172 directed forwardly of the vacuum cleaner and to its side edges, to the rear edges of the recesses 131. The wall portion 173 extends across the front of the frame 36, terminating at the front edges of the recesses 131. The bottom edges of the wall portions 171–173 define a chamber extending from the brush roll 120 to the hole below the impeller 160. The frame 36 above the hole through which the impeller is visible in FIG. 15 has a duct (not illustrated) extending to the rear port 231 (FIG. 20) projecting from the rear of the frame 36, so that the impeller may draw air from the vicinity of the brush roll and direct it through the port 231.

Figure 9:
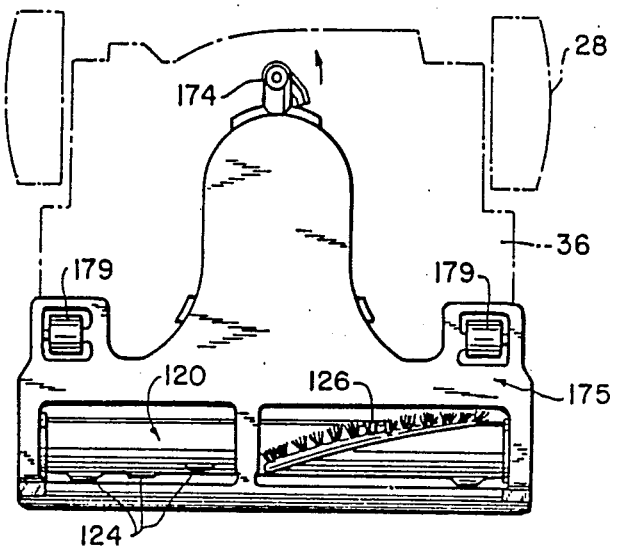
FIG. 9 is a bottom view of the vacuum cleaner with the bottom plate in position.
Figure 10:
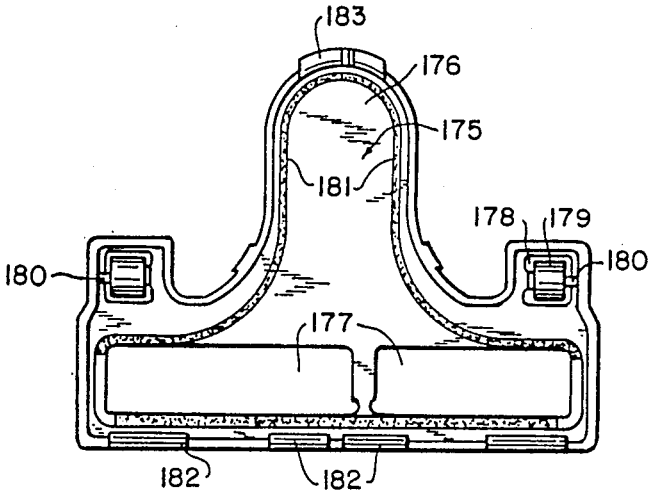
FIG. 10 is a top view of the bottom plate.

As illustrated in FIGS. 9–11, a bottom plate 175 is releasably held to cover the bottom of the housing 170. The bottom plate thus has a rear portion 176 under the impeller, and a front portion under the brush roll. The front portion has a pair of generally rectangular aperetures 177 extending below the portions of the beater bar between the mounting caps 127 and the annular drive belt groove 122. A seal 181 is affixed to the top of the bottom plate 175 to conform to the outline of the walls 171–173, except in the vicinity of the mounting caps 127, the mounting caps 127 extending slightly below the bottom of the frame 36 in order to provide positive positioning of the bottom plate 175. Accordingly, the seal 181 seals the housing 170 except for the apertures 177 below the brush roll. In order to releasably hold the bottom plate 175 on the frame 36, a plurality of hook-shaped projections 182 are provided extending upwardly from the front edge of the bottom plate 175 to engage projections 182' formed on the front of the frame 36. An inclined projection 183 extends from the rear of the portion 176 of the bottom plate, for engagement by a rotatable lever 174 as illustrated in FIGS. 9 and 15.

In a further feature of the invention, a pair of wheels 179 are mounted in the base plate 175, for holding the front of the vacuum cleaner a determined distance from the surface being cleaned. The wheels 179 are mounted in holes 178 in wings of the bottom plate extending rearwardly at its side edges, the wheels 179 being freely rotatable about axles 180 extending across the holes 178, for example being affixed to upwardly extending flanges of the bottom plate as shown in FIG. 11.

In a further feature of the vacuum cleaner of the invention, as illustrated in FIG. 24, the bottom of the bottom plate including the rear portion 176, the portions 260 at the sides of the bottom plate adjacent the apertures 177, and the front edge 261 thereof lie in a common plane, but the plate is upwardly recessed as illustrated at 262 in the front corners thereof. This recess thereby forms a channel from both the front edge and sides of the bottom plate, to the apertures 177. In accordance with the invention, these recessed portions 262, on both sides of the bottom plate, improve the cleaning ability of the vacuum cleaner, in the edge regions thereof, by increasing the flow of air into the vacuum cleaner by way of the recesses.

It is of course apparent that this feature of the invention may be effected by different means, i.e., by providing the corner channels by other means than in the bottom plate itself, if a bottom plate of the type disclosed herein is not employed.

Referring now to FIG. 19, therein is illustrated the latch arrangement in accordance with the invention, enabling tilting of the handle assembly. A latch plate 200 is fixedly mounted against the side of the frame 36. For this purpose, for example, the axis 119 of the wheels may pass through an aperture in the plate 200, the axis being held in the frame 36 by conventional means thereby to hold the plate 200 between the frame 36 and the wheel 28. In order to inhibit rotation of the plate 200, a further recess 201 therein engages a suitably located projection on the frame. The lever 30, for adjusting the vacuum cleaner handle position, is pivoted for example as indicated by the reference numeral 212, to the handle and bag mounting assembly 29. The lever 30 extends beyond the pivot 212 and has on its opposite end thereof a laterally extending projection 213 which, in the upright position of the handle, engages a recess 203 formed between a projection 202 of the plate 200, and a cam surface 204 thereon. Since the lever 30 is affixed to the handle and bag mounting assembly, engagement of the projection 213 in the notch 203 inhibits pivoting of the handle from its vertical position. A suitable spring (not shown) is provided in a conventional manner to bias the lever 30 to a position illustrated in FIG. 19. This position corresponds to the position A as illustrated in FIG. 8.

Upon depression of the lever 30, for example by the foot of the user, the lever 30 pivots about the axis 212, until the projection rides upon the cam surface 204. The cam surface 204 extends from the notch 203, forming a generally curved cam surface, the cam surface 204 being interrupted at its other end by a further cam surface 205. The latch formed at the junction of the cam surfaces 204 and 205 is shaped to inhibit passage of the projection 213 there past, while lowering the handle, unless the lever 30 is also being depressed. The position where the other handle when the projection 213 of the levere 30 engages the junction of the cam surfaces 204 and 205 is illustrated at the position B of FIG. 8, the position at which the handle cannot be further depressed until the lever 30 is also depressed. The angle of the handle with respect to the ground surface, at the position B, may be, for example, approximately 45 degrees.

Figure 8:
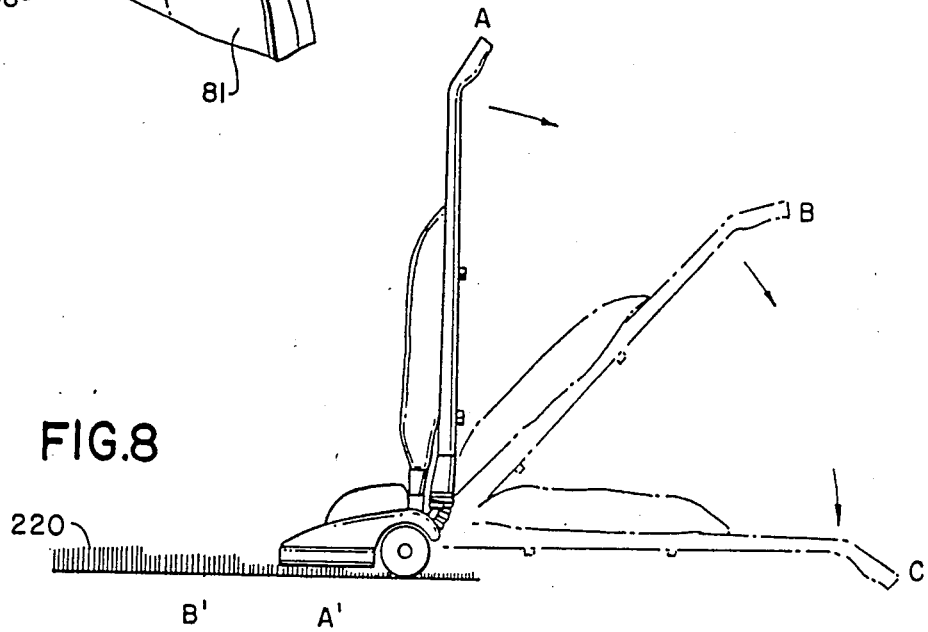
FIG. 8 is a simplified side view of the vacuum cleaner illustrated in several positions of the handle for cleaning.

Once the lever 30 has been depressed, while the projection is at the junction of the cam surfaces 204 and 205, the handle may be further depressed, for example as far as the ground surface, as illustrated at position C of FIG. 8.

In order to ensure that the lever 30 may rotate without interference with the axis 118 of the pivotal axis of the handle and bag mounting assembly 29, it may be provided with a suitable notch 214.

As illustrated in FIG. 16, the sides of the handle and bag mounting assembly 29 opposite the lever 30 is provided, between the frame 36 and cover 25, with a pivot pin 192, for example in a suitable recess 190 therein. A further pin 195 is mounted in upwardly extending walls 196 of the frame, adjacent the front of the frame. The pins 195 and 192 extend horizontally. A spring 194 is supported on the pin 195 by way of bushing 198, a lever 191 pivotally extending from the pin spring abuts the frame 36. The spring 194 resiliently urges the lever 191 forwardly to position the handle in the upright position A of FIG. 8, the forward pivoting of the handle from a vertical position being inhibited by the projection 213 of lever 30 engaging the projection 202 of the plate 200 as shown in FIG. 19.

As the handle 21 is pivoted backwardly during operation, following depression of the lever 30, the lever 191 moves in a direction to compress the spring, thereby to exert a pivotal upper force on the front of the floor engagement unit 20. As a consequence, in accordance with the invention, by downward pivoting of the handle, between the positions A and B of FIG. 8, the downward force of the floor engagement unit 20 on the carpet may be varied, thereby to adapt the cleaning action of the vacuum cleaner to different piles. The junction of the cams 204 and 205, inhibiting relative rotation of the handle and floor engagement unit without further depression of the lever 30, enable the operator to manually tilt the front of the floor engagement unit upwardly without requiring full depression of the handle.

FIG. 16 further illustrates the support ribs 185 in the bottom of the bag receptacle 39.

As discussed above, and referring to FIG. 18, the switch 114 for operating the motor is clamped to the top of the frame 36 by means of suitable resilient projections 115, in conventional manner. In order to enable operation of the switch plunger 240 from the cover 25, a downwardly extending recess 241 is provided in the cover above the operating top 240 of the switch 114. A further downwardly extending recess portion 242 extends downwardly from the bottom 245 of the recess 241, the recess 242 having a smaller diameter than the recess 241. The button 31 is comprised of a cylindrical element 244 adapted to move upwardly and downwardly in the recess 241, the button 244 having a lower extension of smaller diameter extending through the recess 242 to engage the switch button 240. A pair of downwardly extending projections 246 are provided on the button 244, the projections 246 extending through holes 243 in the bottom of the recess 241, the projections 246 having enlarged lower ends to inhibit removal of the element 244. While the button 244 is illustrated in FIG. 18 at its lowermost position and separated from the button 24 of the switch 114, it is apparent that in use, in the unoperated position of the switch, the button 244 engages the button 240, and is not at its lowermost position in the recess 241 unless the switch has been depressed and actuated.

Figure 18:
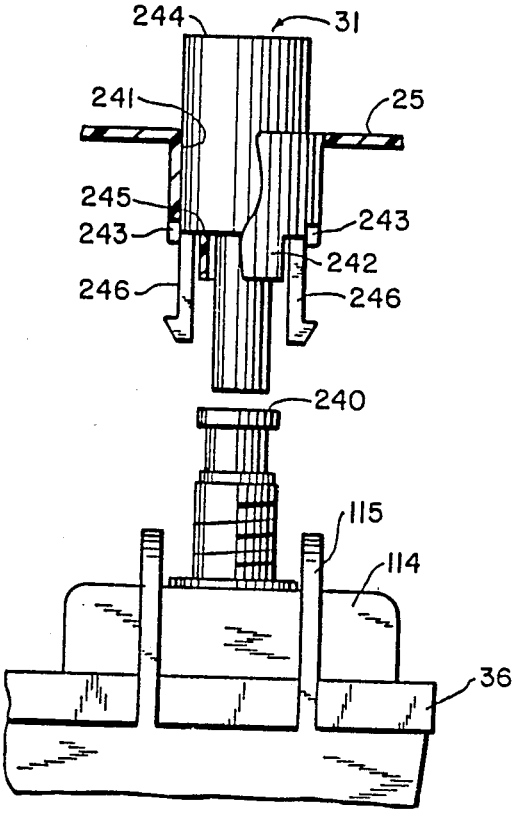
FIG. 18 is an enlarged, partially cross sectional view illustrating the operating switch in accordance with the invention.

The switch arrangement in accordance with FIG. 18 thereby enables control of the motor by means of a switch mounted on the frame, the control being effected by means of a button in the separable cover.

Figure 20:
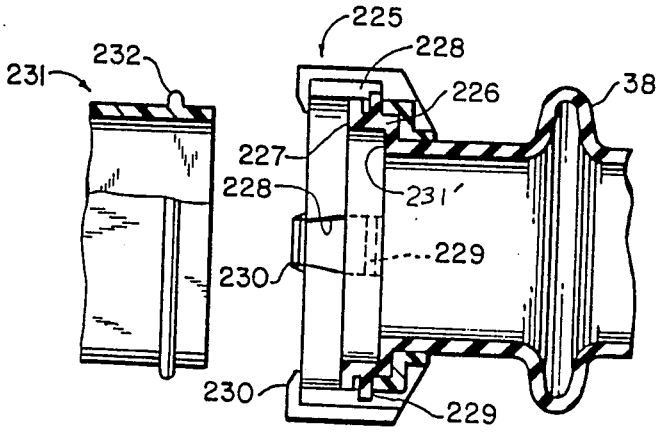
FIG. 20 is a partially cross sectional view illustrating the interconnection of the bellows with the port of the frame.

Referring now to FIG. 20, therein is illustrated an arrangement in accordance with the invention for connecting the bellows 38 to the port 231 of the frame 36. In order to enable the provision of a readily assemblable and disassemblable snap connection, in accordance with the invention an adapter 225 is provided for clamping the bellows to the port. For this purpose, the end of the bellows 38, which may be rectangular in cross section, is formed with a recess 231' adapted to closely receive the end of the port 231. The end of the bellows 38 hence has a portion 226 of greater internal dimension than the adjacent portion of the bellows, for surrounding the end of the port 231, and an outwardly extending end flange 227. The internal surface of the adapter 225 corresponds to the external surface of the end of the bellows 38, the adapter having resilient prongs 230 extending therefrom and adapted to snap behind a projection 232 encircling the port 231 and spaced from the end thereof. It is preferable that at least one projection 230 be provided on each side of the adapter 225.

The adapter further has a plurality of recesses 228, for example aligned with each of the projections 230, the bellows 38 having projections 229 molded therein and positioned to be received by the recesses 228.

The resultant snapped interconnection between the port and the bellows enables the simple and economical interconnection of the bellows and port, the interconnection being releasable.

In accordance with a further feature of the invention, as illustrated in FIGS. 21 and 23, the bumper 32 is comprised of a resilient strip, for example of a molded or extruded plastic, the upper edge of which is formed with a flange 255 adapted to enage a similarly formed surface on the cover. The lower edge of the strip 32 is provided with a curved flange 254 adapted to receive the adjacent lower edge of the cover. The flanges 255 and 254 hence hold the bumper from vertical movement with respect to the cover.

As illustrated in FIG. 21, the bumper 32 has end portions 253 from which the upper and lower flanges are removed. The underside of the cover 25 has a vertical channel 251 formed therein, the rear side of the channel 251 having a vertical gap 250. Rearwardly of the channel 251, a flange 252 is angled inwardly, the flange 252 defining, for example, the rear edge of the lower portion of the cover in front of the wheels. The unflanged portion 253 of the bumper 32 is bent around the flange 252, and into the channel 251 by way of the gap 250. This arrangement has been found to firmly hold the bumper in place, and to permit the easy assembly of the bumper by vertically forcing the ends thereof into the channel 251.

Figure 25:
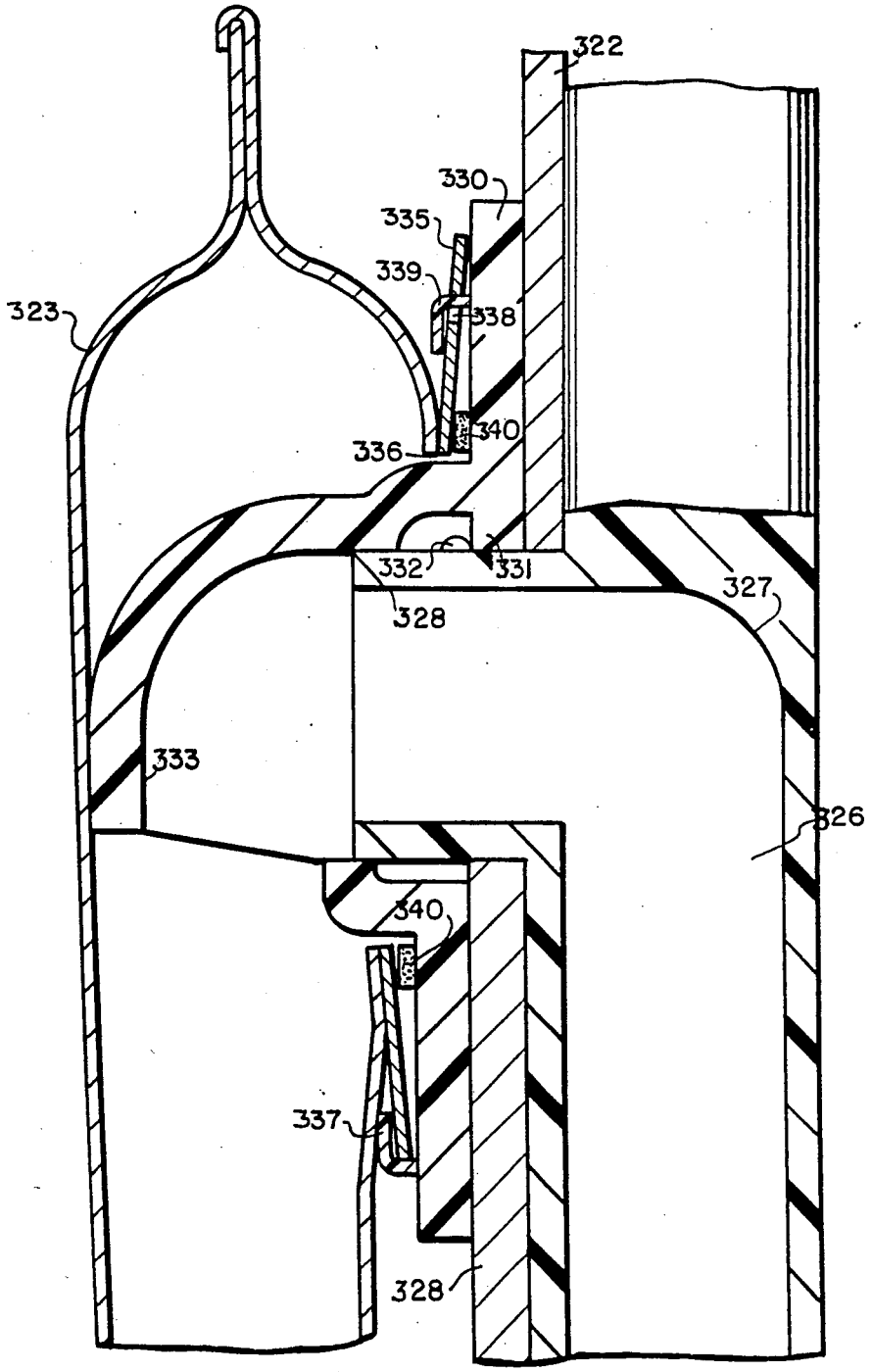
FIG. 25 is an enlarged detail of a porous dust bag mounting arrangement.

As illustrated in FIG. 25, the elbow 327 of the handle includes a stub 328, preferably of rectangular cross section, extending out of the front of the handle. The outer bag 322 is held against the front of the handle 321 by an outer bag flange 330, the outer bag flange having a suitable catch 331 cooperating with a projection 332 on the stub 328 to enable the flange 330 to be installed by snapping it on the stub 328, Of course, additional projections and latches may be provided holding the flange 330 on the stub. The flange 330 carries a diverter or deflector 333 for directing dirt laden air from the elbow 327 downwardly into the paper bag 323.

The paper bag 323 is provided with a flange 335 affixed to its aperture 336. The flange 335 is received in hook shaped pivots 337 projecting from the bottom of the flange 330, so that the paper bag flange 335 may be pivoted into flush engagement with the flange 330. One or more apertures 338 in the upper portion of the paper bag flange 335 are positioned to receive snap pins 339 projecting from the top outer bag flange 330. Suitable sealing gaskets 340 are provided surrounding the aperture of the dust bag flange 335, the gaskets being preferably affixed to the outer bag flange 330. Alternatively, a rubber diaphragm may be provided as a part of the disposable bag to seal on the projection of the lit tube.

In the arrangement illustrated in FIG. 25, some criticality may exist in the positioning of the holes 338 and the snap pins 339.

Figure 26:
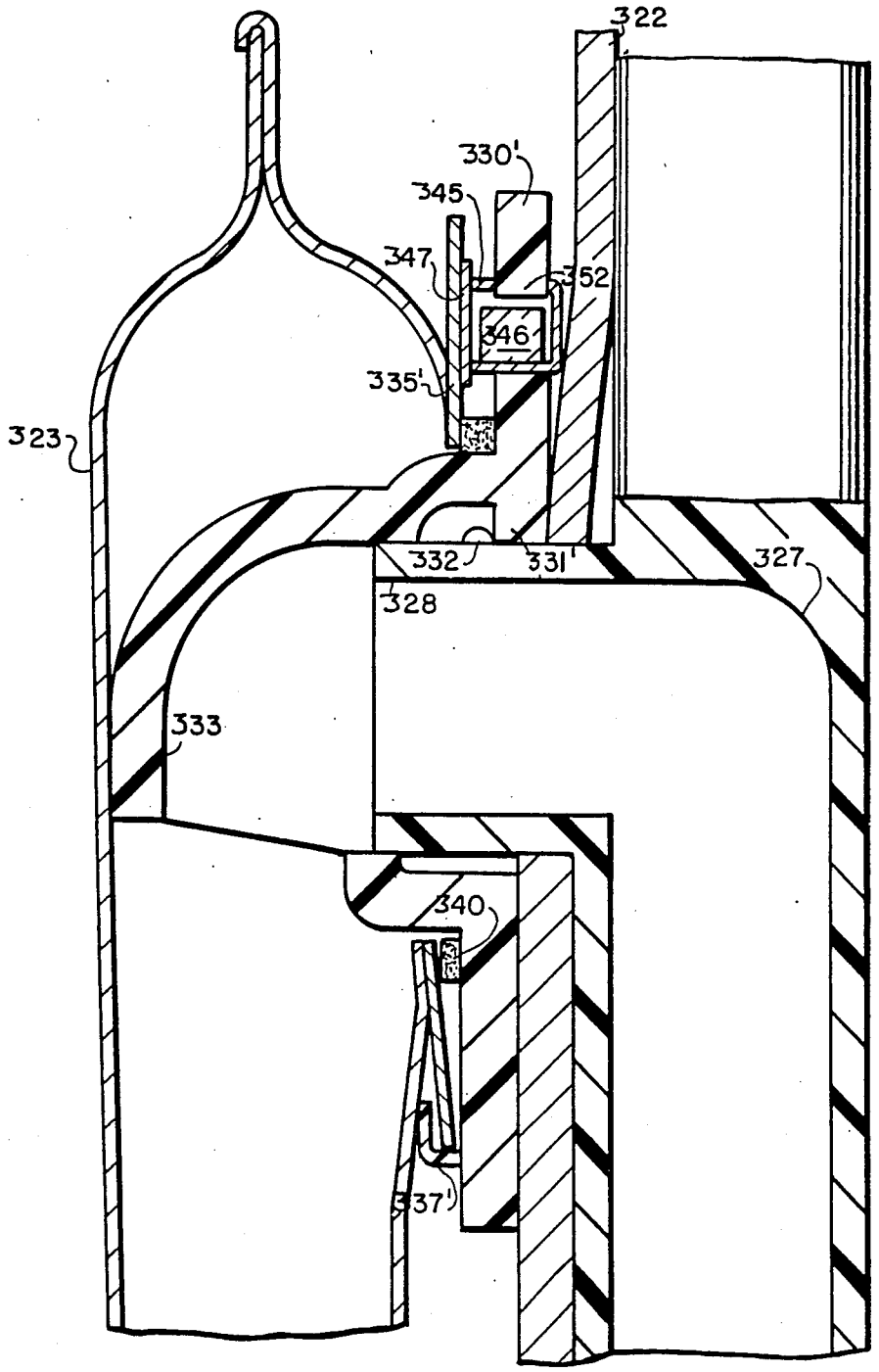
FIG. 26 is an enlarged cross sectional view of one embodiment of a porous dust bag mounting arrangement in accordance with the invention.

In the embodiment of the invention illustrated in FIG. 26, the outer bag flange 330′ has a latching projection 331′ to enable snapping of the flange of the stub 328, as in the prior arrangement. The outer bag flange 330′ also has a lower hook-shaped pivot arrangement 337, as in the prior arrangement. In this embodiment of the invention, an elongated steel channel 345 surrounds a magnet 346. The iron forms paths of high magnetic conductivity, and serves to concentrate total magnetic force or unit into the most useful area. The flange 335′ of the dust bag has a steel plate 347 mounted thereon, for example adhesively, or by means of prongs extending therethrough. The magnet 346 thereby attractively pulls the plate 347, and hence the flange 335′, to the poles defined on the member 345.

Figure 27:
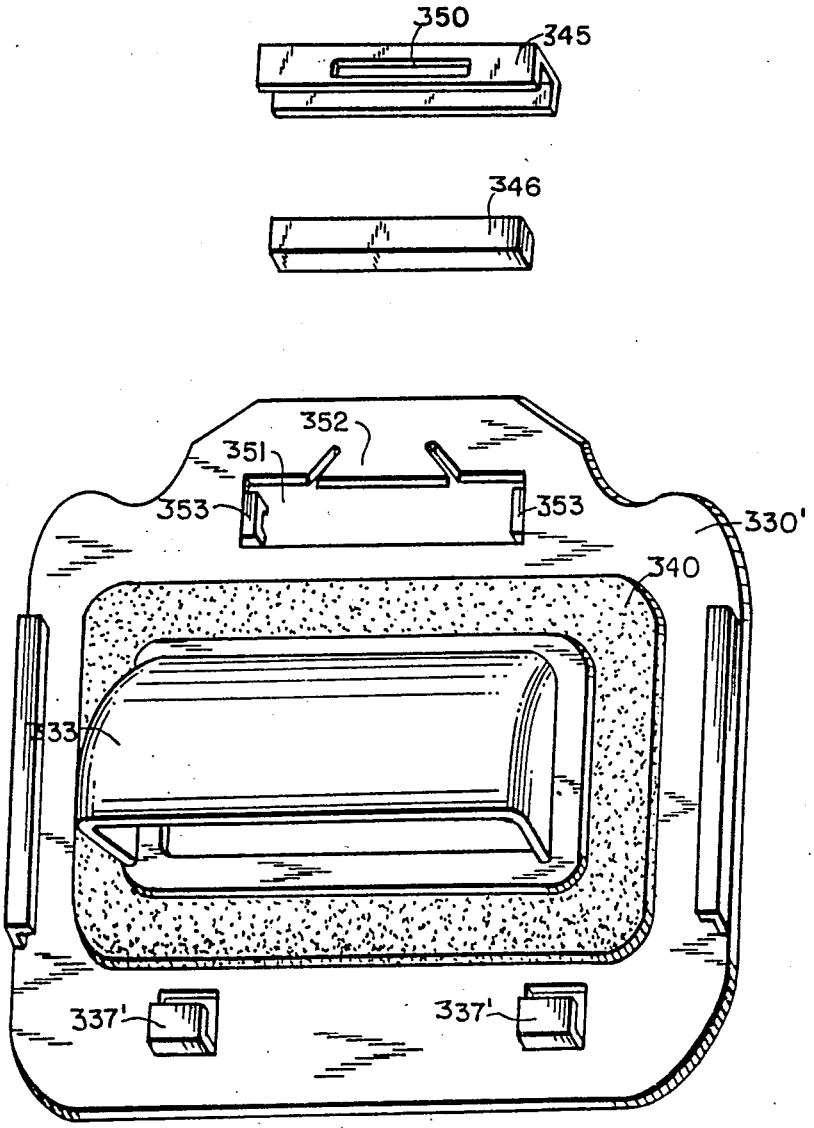
FIG. 27 is an exploded view of the outer bag flange of FIG. 26.
Figure 28:
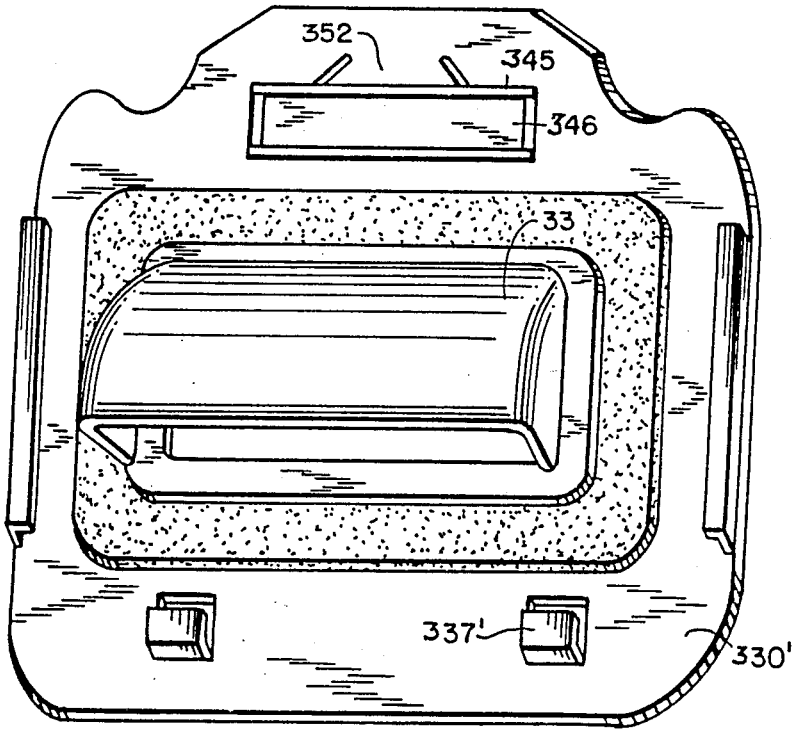
FIG. 28 is an end view of the outer bag flange of FIG. 26.

As illustrated in FIG. 27, the channel 345 may have an elongated recess 350 in one side, to enable it to be snapped into a rectangular aperture 351 of the flange 330′. A projection 352 adjacent the aperture 351 is thus adapted to snap into the aperture 350 of the channel 345, to hold the channel to the flange 330′. The projection 352 may be relieved at its side as illustrated. The flange 330′ has further projections 353 extending into the ends of the aperture 351 to prevent the magnet-channel assembly from pulling loose when the disposable bag flange is disassembled. It is, thus, apparent that the magnet and channel may be readily and economically mounted in the flange 330′. A frontal view of the flange 330′, with the magnet assembly mounted therein, is illustrated in FIG. 28.

Figure 29:
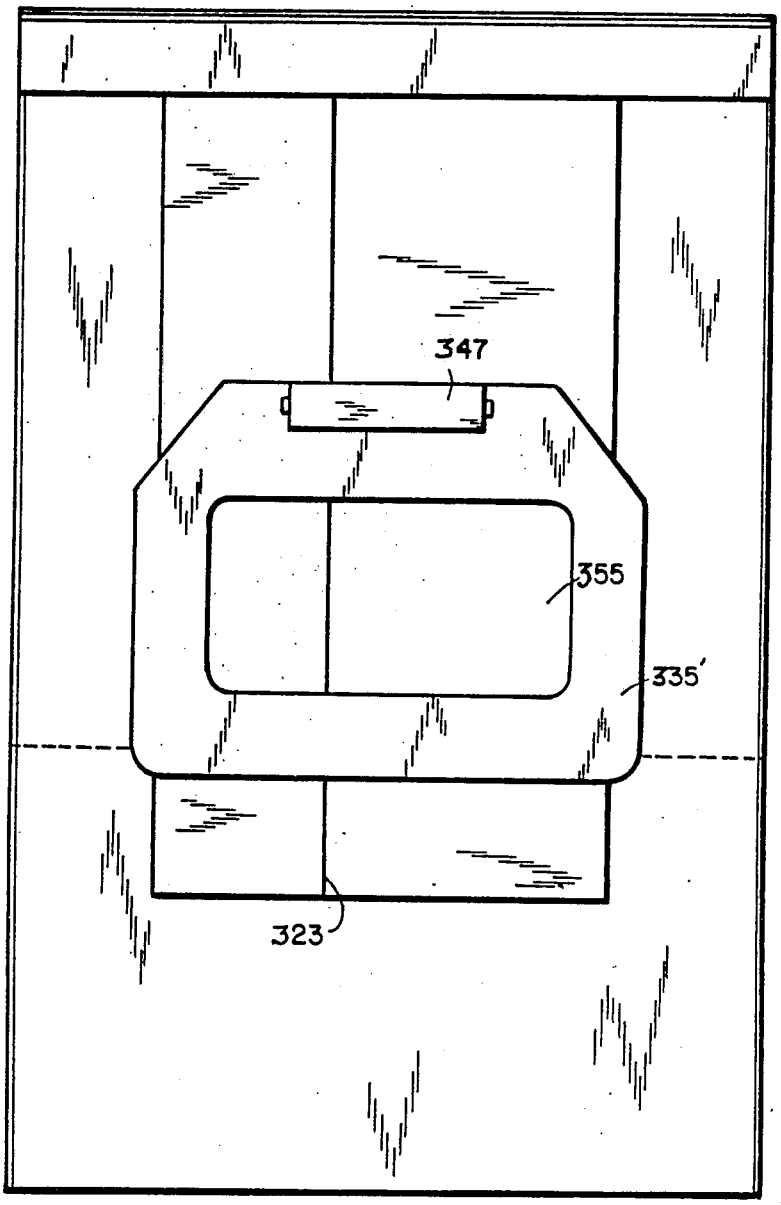
FIG. 29 is a view of the porous bag flange of FIG. 27.

As illustrated in FIG. 29, the dust bag flange 335′ has a central aperture 355 for receiving the deflector of the outer bag flange. The plate 347 is mounted in the upper portion of the flange 335, generally aligned with the poles defined by the edges of the channel 245.

Figure 30:
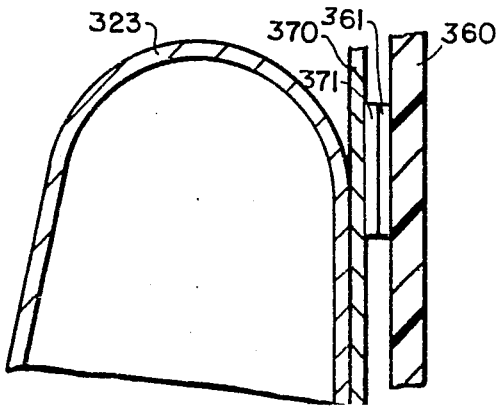
FIG. 30 is an illustration of a portion of the mounting bag arrangement of FIG. 26 in accordance with a further embodiment of the invention.
Figure 31:
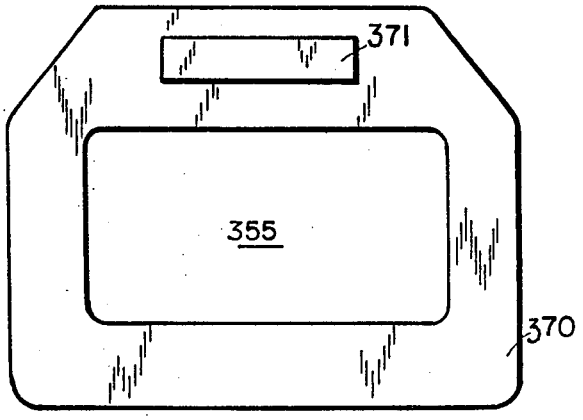
FIG. 31 is a view of the porous bag flange of FIG. 30.
Figure 32:
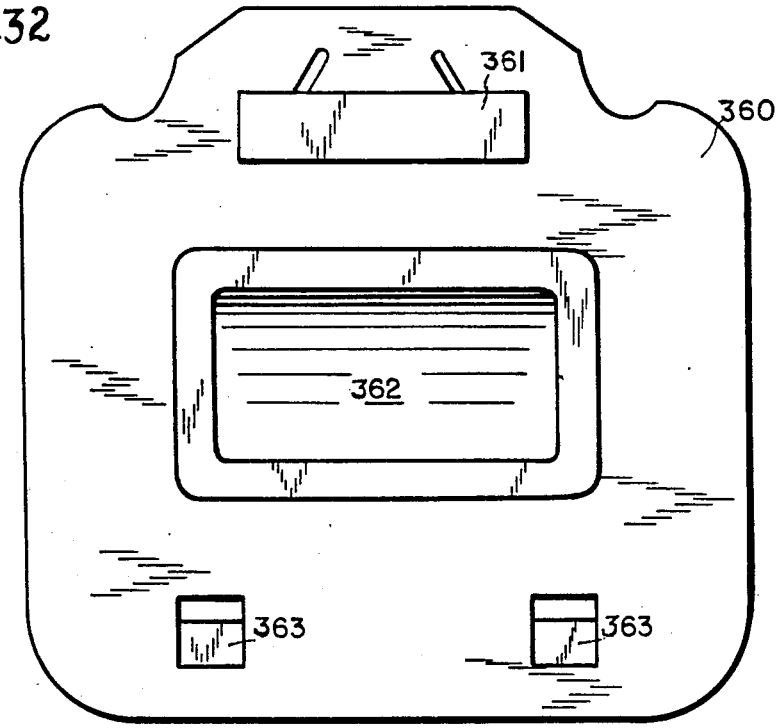
FIG. 32 is an end view of the outer bag flange of the embodiment of the invention of FIG. 30.

In a still further embodiment of the invention, as illustrated in FIGS. 30–32, instead of the magnetic holding arrangement illustrated in FIGS. 26–29, the upper portion of a preferably generally rectangular area has one element of a releasable locking surface fastener 361 mounted thereon, such fastener being, for example, locking fiber or hook and loop surface fasteners, such as a Velcro or Scotchmate fastener. The outer bag flange 360 is otherwise unchanged from the previously disclosed arrangements, having the deflector 362 and lower pivot 363.

The dust bag flange 370 has an area in the upper portion thereof on which a preferably generally rectangular other element of the releasable locking surface fastener 371 is affixed. As illustrated in FIG. 30, the two fastener elements 361 and 371 releasably engage one another, to enable holding of the dust bag flange to the outer bag flange. In this arrangement, as in the arrangement illustrated in FIGS. 26–29, it is apparent that critical location of the mounting elements is not required and the need for visual alignment is eliminated.

A modification of the porous bag mounting arrangements of FIGS. 26-29 is illustrated in FIGS. 33–35, the modification only being directed to the assembly of the dust bag flange 380. In this embodiment of the invention, a layer 381 of a self-stick adhesive is applied to the steel plate 347, and a peel-off membrane 382, for example of paper or plastic, is applied to the self-stick adhesive layer 381. The flange 380 has a central aperture 384 for receiving the deflector of the outer bag flange, and is provided with a horizontal fold line 385 extending generally centrally of the aperture 384 across the flange 380. The fold line 385 is formed by conventional means to enable the simple folding of the flange 380 along this line, for example by thinning or weakening the material along this line.

When the dust bag mounting arrangement of FIGS. 33 and 34 is employed in use in a vacuum cleaner, it is employed in the same manner as illustrated in FIG. 26, the self-stick adhesive and peel-off membrane layers, being thin, not interfering with the magnetic attraction of the holding arrangement.

When it is desired to dispose of the dust bag currently mounted on the vacuum cleaner, it is removed in the conventional manner, i.e. by first opening the outer bag, and then pivoting the dust bag flange to release the magnetic attraction. After removal of the porous dust bag from the outer bag, the peel-off membrane is removed from the selfstick adhesive, and the dust bag flange 380 is bent along the fold line 385, until the self adhesive layer 381 engages the folded over bottom of the flange, and sticks thereto as illustrated in FIG. 35. Such folding over and sealing of the flange closes the aperture of the dust bag, to inhibit dirt from falling out of the bag as it is carried to a disposal area. The flange in this environment of the invention, as in the other embodiments, may be of a cardboard or plastic material, the selection of the material not being critical.

While the invention has been disclosed and described with reference to a limited number of embodiments, it is apparent that variations and modifications may be made therein, and it is, therefore, intended in the following claims to cover each such variation and modification as falls within the true spirit and scope of the invention.

What is claimed is:

1. In a vacuum cleaner wherein vacuum pump means are provided to direct dirt-laden air through duct means, connection means are provided for mounting a porous dust bag on said duct means to receive said dirt-laden air, and a porous outer bag is mounted to surround said porous dust bag, said connection means comprising a stub at the end of said duct means and received in an aperture of said outer bag, and an outer bag flange mounted to said stub and holding said outer bag thereon, a dust bag flange mounted about an air receiving aperture in said dust bag, and means for releasably holding said dust bag flange to said outer bag flange and including pivot hook means on the bottom portion of said outer bag flange for engaging the bottom of said dust bag flange to enable pivoting of said dust bag flange thereabout, the improvement wherein said holding means comprises first and second releasable matching locking surface fasteners, said first fastener being affixed to the upper side of said dust bag flange facing said outer bag flange and said second fastener being on the upper side of the outer bag flange facing the first fastener and releasably engaging the first.

2. The vacuum cleaner of claim 1 wherein said releasable matching locking surface fasteners comprise locking fiber surface fasteners.

3. The vacuum cleaner of claim 1 wherein said first and second releasable matching locking surface fasteners comprise rectangular strips of matching locking fiber fasteners affixed to facing sides of said dust bag flange and outer bag flange, respectively, only above said stub.

4. A vacuum cleaner dust bag comprising a porous bag having an aperture, a flange affixed to said bag surrounding said aperture and having a substantialy flat surface facing away from said bag, and a strip of a releasable locking fiber fastening material affixed to said surface and extending along only one side of said aperture, the remaining portions of said surface means being free of fastening means.

* * * * *